United States Patent [19]

Gunter

[11] Patent Number: 4,632,592

[45] Date of Patent: Dec. 30, 1986

[54] LEAKPROOF JOINT CONSTRUCTION AND METHOD AND APPARATUS FOR MAKING THE SAME

[75] Inventor: James C. Gunter, Greensburg, Pa.

[73] Assignee: Robertshaw Controls Company, Richmond, Va.

[21] Appl. No.: 735,540

[22] Filed: May 20, 1985

Related U.S. Application Data

[62] Division of Ser. No. 410,438, Aug. 23, 1982, Pat. No. 4,531,279.

[51] Int. Cl.[4] ..... F16B 5/00

[52] U.S. Cl. ..... 403/285; 403/274; 403/282; 29/509

[58] Field of Search ..... 403/274, 285, 343, 282; 29/509

[56] References Cited

U.S. PATENT DOCUMENTS

| | | | |
|---|---|---|---|
| 3,357,388 | 12/1967 | Dunn | 29/509 |
| 3,404,648 | 10/1968 | Rosbottom | 29/522 |
| 3,579,809 | 5/1971 | Wolf | 29/509 |
| 3,690,706 | 9/1972 | Boik et al. | 403/282 |
| 4,035,901 | 7/1977 | Lux et al. | 29/509 X |
| 4,174,559 | 11/1979 | Persik et al. | 403/274 X |
| 4,459,735 | 7/1984 | Sawdon | 29/509 |
| 4,531,279 | 7/1985 | Gunter | 29/509 |

*Primary Examiner*—Cornelius J. Husar
*Assistant Examiner*—Joseph A. Fischetti
*Attorney, Agent, or Firm*—Candor, Candor & Tassone

[57] ABSTRACT

A leakproof joint construction for a pair of members disposed in abutting relation and method and apparatus for making the same are provided, the leakproof joint construction having part of one of the members deformed into an adjacent part of the other of the members so that the parts of the members are disposed completely beyond the plane of the outer surface of the other member while respectively being integrally interconnected to the remainder of the members by tubular portions of the members. The parts are interlocked together by an outward staking of the part of the one member into the tubular portion of the other member by a compaction of the parts, the parts and the tubular portions of the members respectively defining like polygonal configurations.

2 Claims, 15 Drawing Figures

LEAKPROOF JOINT CONSTRUCTION AND METHOD AND APPARATUS FOR MAKING THE SAME

CROSS REFERENCE TO RELATED APPLICATION

This application is a divisional patent application of its copending parent patent application, Ser. No. 410,438, filed Aug. 23, 1982, now U.S. Pat. No. 4,531,279.

BACKGROUND OF THE INVENTION

1. Field of the Invention

This invention relates to an improved leakproof joint construction for a pair of members disposed in abutting relation as well as to a method and apparatus for making such a joint construction or the like.

2. Prior Art Statement

It is known to provide an apparatus and method for joining two metal members together with a lancing and staking operation that comprises the lancing and forming of a part of one of the members through an unblanked part of the other of the members, and, thereafter, the staking of the formed part of the one member to an adjacent surface means of the other member to secure the members together in abutting relation, the apparatus having a punch and a reciprocating head that cooperate together to perform the lancing and staking operation on the members. For example, see the U.S. Pat. to Lux et al, No. 4,035,901 wherein the lancing and staking apparatus has a single reciprocating head provided with a first section that performs the lancing and forming step with the punch on the first stroke of the head and provided with a second section that forms the staking step with the punch on a second stroke thereof.

It is also known to form a leakproof joint construction with an apparatus similar to the previously described apparatus wherein a part of one of the abutting members is deformed into an adjacent part of the other of the members so that the parts of the members are disposed completely beyond the plane of the outer surface of the other member while respectively being integrally interconnected to the remainder of the members by tubular portions of the members, the parts being interlocked together by an outward staking of the part of the one member into the tubular portion of the other member by a compaction of the parts. For example, see FIGS. 8 and 9 of this application wherein such a joint construction is provided and the same has the parts and the tubular portions of the two members defining circular configurations. Other leakproof joint constructions are illustrated and described in the U.S. Pat. to Dunn, No. 3,357,388; the U.S. Pat. to Rosbottom, No. 3,404,648; the U.S. Pat. to Wolf et al, No. 3,579,809 and the U.S. Pat. to Sawdon, No. 4,459,735.

SUMMARY OF THE INVENTION

It is one feature of this invention to provide an improved leakproof joint construction for a pair of members disposed in abutting relation.

In particular, it is believed according to the teachings of this invention that if the joint construction has the deformed parts of the two abutting members, as well as in the tubular portions thereof, defining substantially like polygonal configurations, the subsequent compaction of the parts together will cause the part of one of the members to be staked into the tubular portion of the other member in such a manner that that particular side of the tubular portion of the other member will be uniquely deformed to provide such interlocking relation as will be apparent hereinafter.

For example, one embodiment of this invention provides a leakproof joint construction for a pair of members disposed in abutting relation, the joint construction having a substantially rectangular part of one of the members deformed into an adjacent substantially rectangular part of the other of the members so that the parts of the members are disposed completely beyond the plane of the outer surface of the other member while respectively being integrally interconnected to the remainder of the members by substantially straight sided tubular portions of the members. The parts are interlocked together by an outward staking of one pair of opposed sides of said tubular portion of the part of the one member into the tubular portion of the other member by the compaction of the parts. One pair of opposed sides of the one member and a corresponding one pair of opposed sides of the tubular portion of the other member each being initially deformed so as to be disposed at an acute angle relative to the plane of the other member and the other pair of opposed sides of the one member and the corresponding other pair of opposed sides of the tubular portion of the other member each being initially deformed so as to be substantially at a right angle relative to the plane of the other member, the one pair of opposed sides of the one member and the corresponding one pair of opposed sides of the other member each having been toggled over center when staked so as to be disposed at an obtuse angle relative to the plane of the other member while the other pair of opposed sides of the one member and the corresponding other pair of opposed sides of the other member each remain substantially at a right angle to the plane of the other member.

Accordingly, it is an object of this invention to provide an improved leakproof joint construction for a pair of members disposed in abutting relation, the joint construction having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
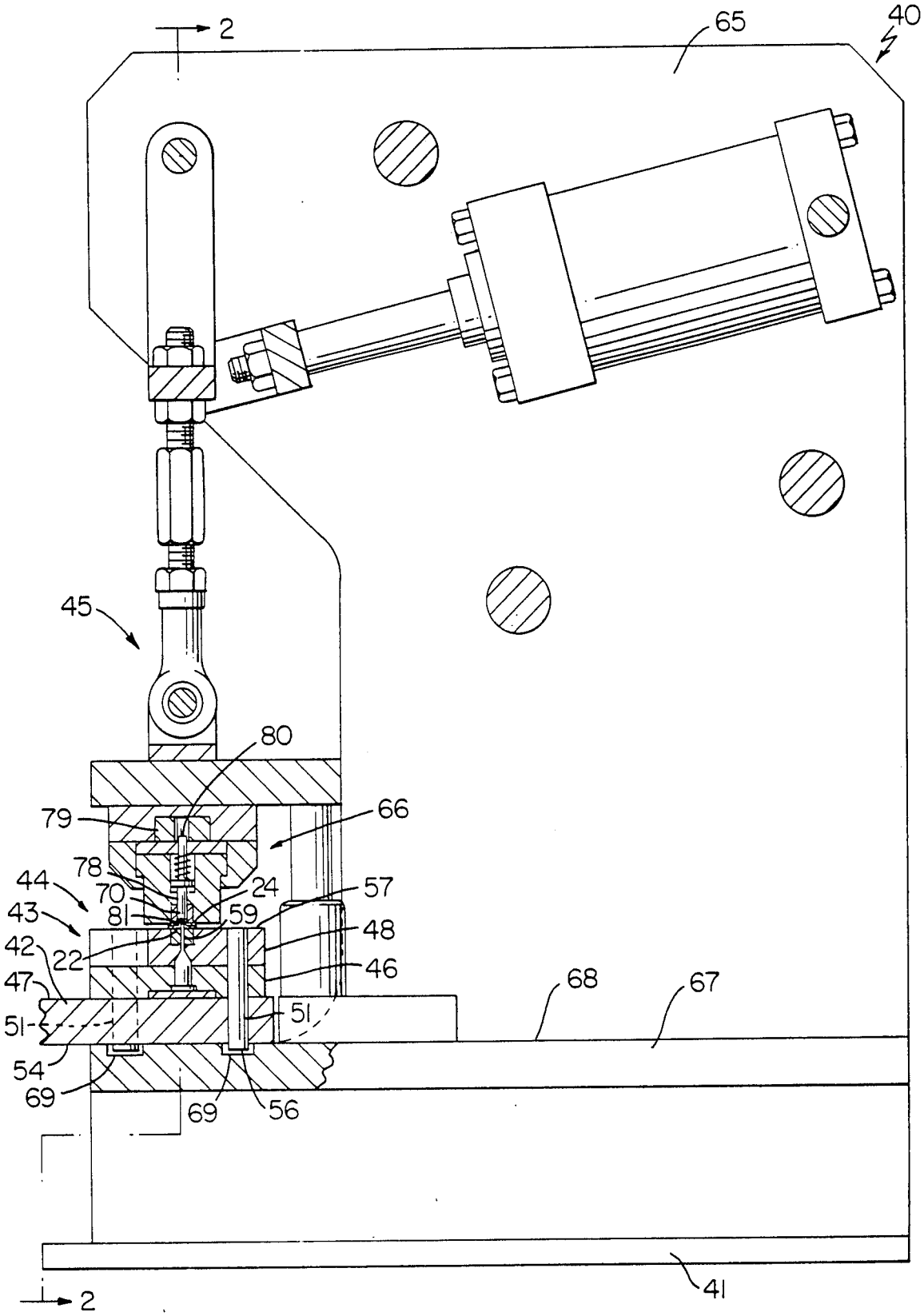
FIG. 1 is a fragmentary view, partially in cross section, of the forming and staking apparatus of this invention.

While the various features of this invention are hereinafter described and illustrated as being particularly adapted to provide a substantially rectangular joint construction for a pair of abutting members of any suitable material, it is to be understood that the various features of this invention can be utilized singly or in any combination thereof to provide a joint construction having any suitable number of sides so that the same will be substantially polygonal in configuration.

Therefore, this invention is not to be limited to only the embodiment illustrated in the drawings, because the drawings are merely utilized to illustrate one of the wide variety of uses of this invention.

Figure 10:
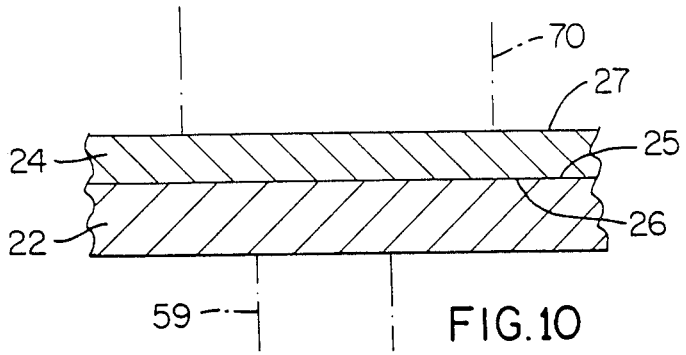
FIG. 10 is an enlarged fragmentary cross-sectional view illustrating two members that will have the joint construction formed therein as illustrated in FIGS. 13–15 by the method and apparatus of this invention that is illustrated in FIGS. 1–7.
Figure 14:
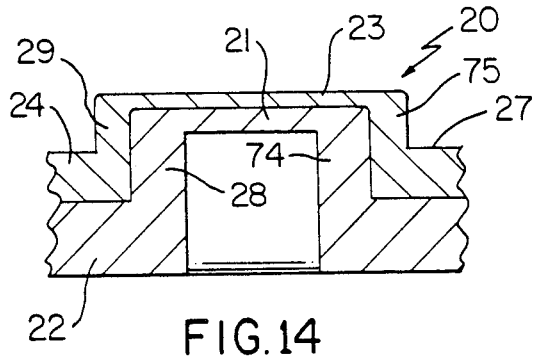
FIG. 14 is a cross-sectional view taken on line 14—14 of FIG. 13.
Figure 15:
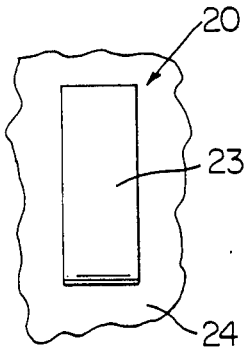
FIG. 15 is a reduced fragmentary view looking down on the top of the joint construction of FIG. 14.
Figure 13:
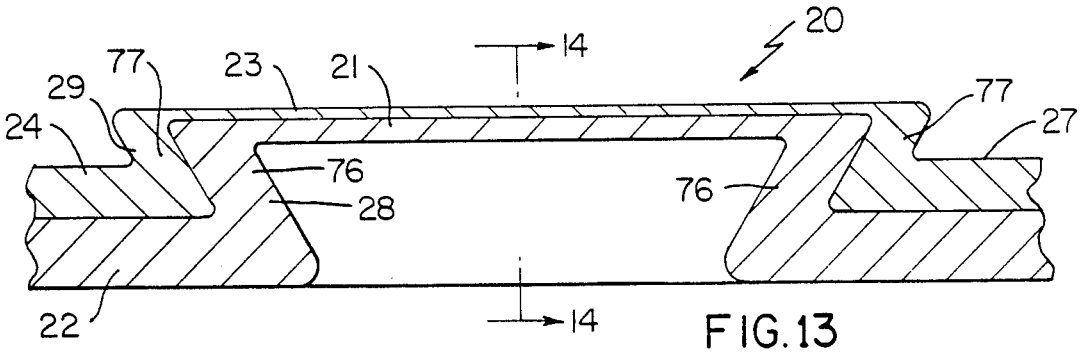
FIG. 13 is a view similar to FIG. 12 and illustrates the improved joint construction of this invention having been formed in the members of FIG. 10.

Referring now to FIGS. 13–15 the improved joint construction of this invention is generally indicated by the reference numeral 20 and comprises a part 21 of a first member 22 that has been deformed into an adjacent part 23 of another member 24 while those members 22 and 24 are disposed in the abutting relation illustrated in FIG. 10 wherein the surface 25 of the member 22 is disposed against the surface 26 of the member 24. The part 21 of the member 22 has been deformed into the part 23 of the member 24 in such a manner that the parts 21 and 23 are disposed beyond the plane of the outer surface 27 of the member 24 with the parts 21 and 23 being respectively integrally interconnected to the remainder of the members 22 and 24 by substantially tubular portions 28 and 29 of the members 22 and 24. The parts 21 and 23 of the members 22 and 24 have been compacted together in a manner hereinafter set forth so as to cause the part 21 of the member 22 to interlock into the tubular member 29 of the member 24 in the manner illustrated in FIG. 13 so that the members 22 and 24 are interconnected together by the joint construction 20 as will be apparent hereinafter, such joint construction 20 being substantially leakproof as the tubular portion 29 of the outer member 24, as well as the tubular portion 28 of the inner member 22, is uninterrupted in contrast to a lanced and staked joint construction as set forth in the aforementioned U.S. Pat. No. 4,035,901.

The parts 21 and 23 of the members 22 and 24, as well as the tubular portions 28 and 29 thereof, all define substantially like polygonal configurations and in the embodiment illustrated in the drawings, each polygonal configuration is a substantially rectangular configuration as best illustrated in FIG. 15 and will be later described.

As previously stated, it is known to provide a leakproof joint wherein the unblanked parts of the members as well as the respective tubular portions thereof are substantially circular in configuration.

Figure 8:
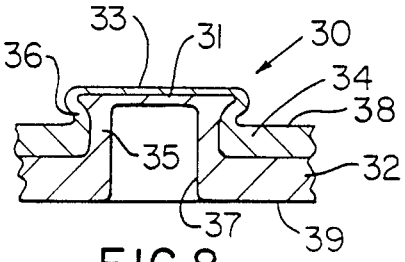
FIG. 8 PRIOR ART
FIG. 8 is an enlarged fragmentary cross-sectional view illustrating a prior art joint construction.
Figure 9:
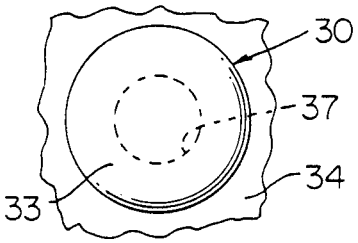
FIG. 9 PRIOR ART
FIG. 9 is a top view of the prior art joint construction of FIG. 8.

For example, reference is now made to FIGS. 8 and 9 wherein a prior art leakproof joint construction is generally indicated by the reference numeral 30 and is defined by an unblanked circular part 31 of the member 32 being deformed into a circular unblanked part 33 of the member 34, the parts 31 and 33 being integrally interconnected to the respective members 32 and 34 by circular tubular portions 35 and 36. The part 31 of the member 32 is interlocked to the tubular portion 36 of the member 34 completely around the entire periphery of the part 31 as illustrated in FIG. 8 during a subsequent compaction of the parts 33 and 31 of the members 32 and 34. However, it can be seen that the tubular portion 35 of the member 32 has an internal sidewall means 37 that is disposed substantially at a right angle to the plane of the outer surface 38 of the member 34 as illustrated in FIG. 8.

It is believed that the surface 37 of the member 32 is defined by a substantially circular punch that is deformed into the side 39 of the member 32 and remains in the tubular portion 35 thereof during the subsequent compaction of the parts 31 and 33 together so as to define the substantially circular sidewall means 37 as illustrated in FIG. 9.

However, it is believed according to the teachings of this invention that an improved interlocking function will take place in the joint construction if the inner and outer tubular portions of the members have at least an adjacent section thereof defining an obtuse angle with the plane of the outer surface of the outer member as will be apparent hereinafter.

In order to fully understand the structure of the joint construction 20 of this invention, it is believed necessary to set forth sufficient details of the method and apparatus for forming the joint construction 20 even though basically such method and apparatus is substantially the same as set forth in the aforementioned U.S. patent to Lux et al, U.S. Pat. No. 4,035,901 except for the clearance between the female die member and punch thereof as will be apparent hereinafter whereby this patent is being incorporated into this disclosure by this reference thereto.

As illustrated in FIGS. 1–7, the method and apparatus of this invention is generally indicated by the reference numeral 40 and is basically of the type disclosed and claimed in applicant's copending patent application, Ser. No. 372,630, filed Apr. 28, 1982, whereby this copending patent application is being incorporated into this disclosure by this reference thereto.

The apparatus 40 includes a main frame means 41 rotatably carrying an indexable table or carrier means 42 rotatable in an indexing manner about an axis (not shown) in a manner well known in the art and having a holding means 43 thereon for being indexed to a station 44 wherein the forming and staking unit 45 of this invention is adapted to form the joint construction 20 on the pair of members 22 and 24 carried in abutting relation by the holding means 43 as illustrated in FIG. 10.

Figure 2:
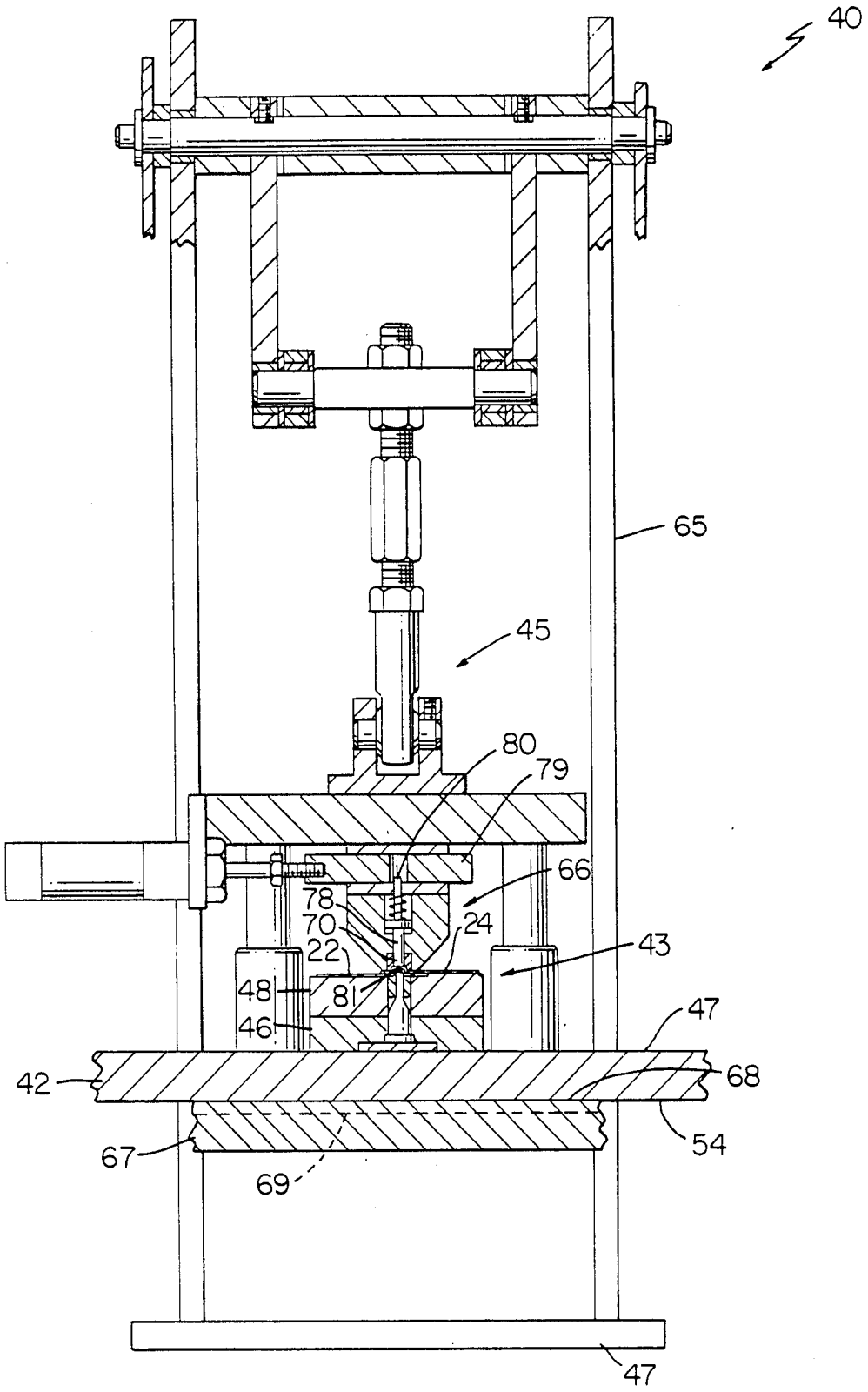
FIG. 2 is a fragmentary cross-sectional view taken one line 2—2 of FIG. 1.
Figure 3:
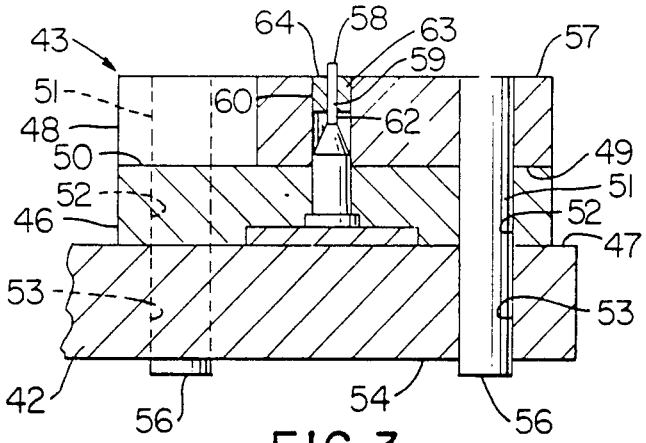
FIG. 3 is an enlarged fragmentary cross-sectional view of the punch portion of the forming and staking apparatus of FIGS. 1 and 2.

The holding means 43 comprises a first block or plate 46 secured to the top surface 47 of the table or carrier means 42 in any suitable manner and a second block or plate 48 having a flat bottom surface 49 adapted to rest on a flat top surface 50 of the lower block 46 while being movable relative thereto because the top block 48 carries a plurality of posts 51 that are fixed to the upper block 48 and loosely passed through openings 52 in the lower block 46 as well as through aligned openings 53 in the table or carrier means 42 so as to project below the lower surface 54 of the carrier means 42 when the upper block 48 has its bottom surface 49 resting against the top surface 50 of the lower block 46 as illustrated in FIGS. 1, 2 and 3.

Figure 6:
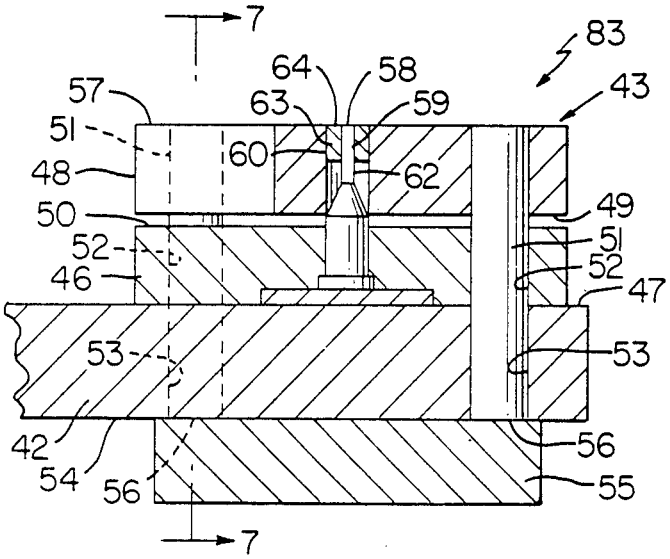
FIG. 6 is a view similar to FIG. 3 and illustrates the punch section during a stripping operation thereof.
Figure 7:
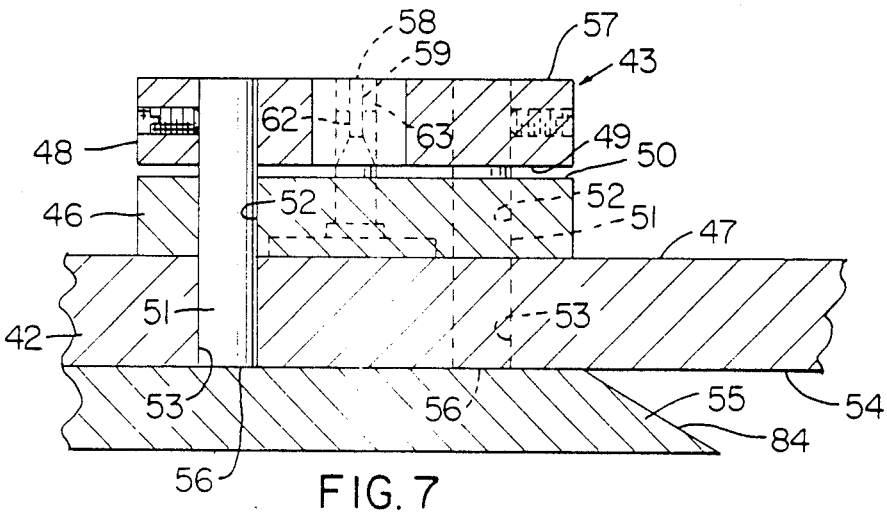
FIG. 7 is a fragmentary cross-sectional view taken on lines 7—7 of FIG. 6.

However, when suitable cam means 55, FIGS. 6 and 7, engages against the lower free ends 56 of the posts 51 so as to move the same upwardly so as to be flush with the bottom surface 54 of the carrier means 42 as illustrated in FIGS. 6 and 7, the upper block 48 of the respective holding means 43 is moved upwardly relative to its lower block 46 in such a manner that the top surface 57 of the block 48 is disposed flush with the top surface 58 of a punch 59 that projects through an opening 60 in the block 48 and is carried by the lower block 46 so as to be non-movable with the upper block 48 for a purpose hereinafter described. The upper end 58 of the punch 59 comprises a reduced portion 62 of the punch 59 which extends into a bearing means 63 that is carried by the respective upper block 48 in the opening 60 thereof so that the upper surface 64 of the bearing means 63 is substantially flush with the top surface 57 of the upper block 48 as illustrated in FIGS. 3 and 6.

The upper block 48 of the holding means 43 has positioning means (not shown) for positioning and holding the two members 22 and 24 in overlapping relation on the top portion 58 of the punch 59 so that the members 22 and 24 can be indexed by the holding means 43 to the station 44 wherein the forming and staking unit 45 performs the forming and staking operations thereon to create the joint construction 20 in the configuration previously set forth.

In particular, the forming and staking unit 45 has a frame means 65 carried by the main frame means 41 of the apparatus 40 and includes a substantially vertically reciprocating head that is generally indicated by the reference numeral 66 and a stationary frame plate 67 disposed spaced beneath the reciprocating head 66 and having an upper surface 68 against which the lower surface 54 of the table or carrier means 42 moves across as illustrated in FIGS. 1 and 2 in order to have its lower surface 54 supported thereon to thereby provide a support function for the particular holding means 43 that has been indexed to the unit 45 and is to be operated on by the head 66 of the unit 45.

The upper surface 68 of the support plate 67 of the frame means 41 has a pair of arcuate grooves 69 formed therein and in which the lower ends 56 of the posts 51 of the upper block 48 of the holding means 43 are adapted to freely move so that the upper block 48 of the holding means 43 will have its lower surface 49 maintained against the upper surface 50 of the lower block 46 as illustrated in FIGS. 1, 2 and 3 at the station 44. In this manner, the upper end 58 of the punch 59 is disposed above the combined planer surfaces 57, 64 of the upper block 48. This feature permits the reciprocating head 66 to perform the forming and staking operations with the punch 59 of the particular holding means 43 at the station 44 in a manner hereinafter set forth.

Figure 11:
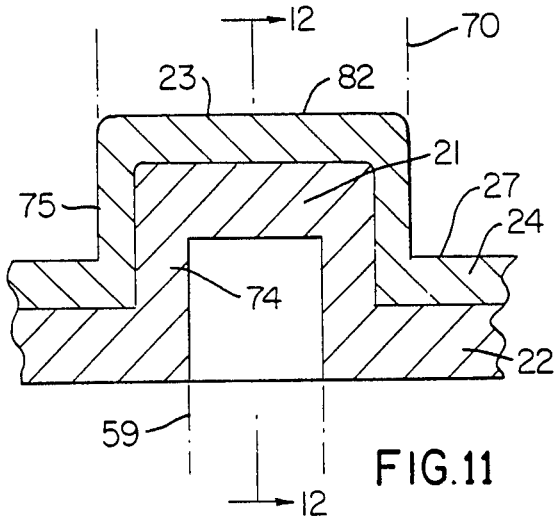
FIG. 11 is an enlarged fragmentary cross-sectional view illustrating one step in the method of this invention for forming the joint construction of this invention in the members of FIG. 10.
Figure 12:
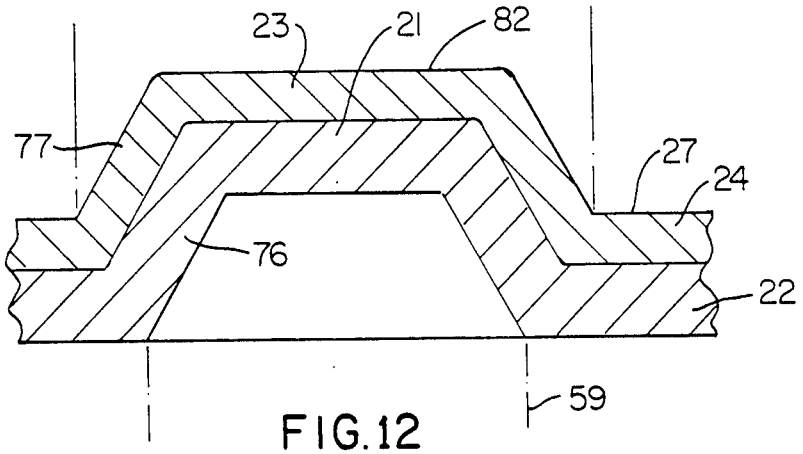
FIG. 12 is a fragmentary cross-sectional view taken on line 12—12 of FIG. 11.

The reciprocating head 66 of the unit 45 is a single head and has a female die member 70 that cooperates with the punch 59 on a first down stroke of the reciprocating head 66 to cause the end 58 of the punch 59 to form the part 21 of the member 22 through the unblanked part 23 of the member 24 as illustrated in FIGS. 10, 11 and 12 wherein the female die member is represented by the dash-dotted lines 70 and the punch by the dash-dotted lines 59.

Figure 4:
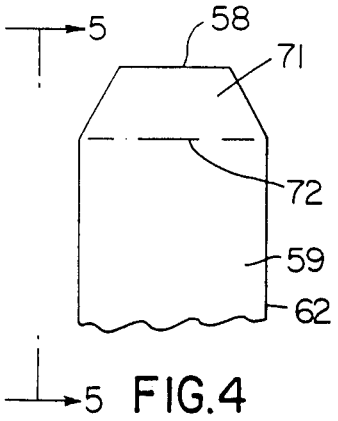
FIG. 4 is an enlarged fragmentary view of one side of the punch of the punch section of FIG. 3.
Figure 5:
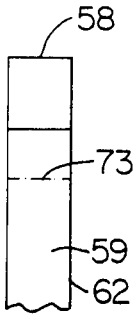
FIG. 5 is a fragmentary view of another side of the punch of FIG. 4 and is taken in the direction of the arrows 5—5 of FIG. 4.

As illustrated in FIGS. 4 and 5, the punch 59 has the end 58 formed to define a substantially truncated triangular upper end portion 71 while the larger base of the truncated triangular end portion 71 is defined by the dashed line 72 and is of the same width as the width of the remainder of the punch 59 and the end 62 thereof. In contrast, when looking at the other side of the punch 59 as illustrated in FIG. 5, the same has a relatively narrow width as represented by the dashed line 73.

In this manner, the punch 59, when forming into the member 22 to form the parts 21 and 23 as illustrated in FIGS. 11 and 12, forms the tubular portions 28 and 29 with respective adjacent flat sides 74 and 75 that are substantially transversely disposed along the long sides of the rectangular configuration being formed by the punch 59 with the female die member 70. In this manner, the sides 74 and 75 of the tubular portions 28 and 29 are disposed substantially at right angles relative to the plane of the outer surface 27 of the member 24.

However, the short or narrow sides 76 and 77 of the tubular portions 28 and 29 as illustrated in FIG. 12 are initially disposed at acute angles relative to the plane of the outer surface 27 of the member 24 in view of the truncated triangular end portion 71 of the punch 59 as illustrated in FIG. 4.

The female die member 70 and the punch 59 on the first stroke of the reciprocating head 66 of the unit 45 forms the parts 21 and 23 of the members 22 and 24 so that the parts 21 and 23 are disposed beyond the plane of the outer surface 27 of the member 24 as illustrated in FIGS. 11 and 12.

In this manner, the female die member 70 comprises a first means of the head 66 that performs a forming step on a first stroke of the head 66.

The reciprocating head 66 then moves upwardly relative to the holding means 43 so that an anvil member 78 of the reciprocating head 66 can then be locked in a position by a locking member 79 moving over the upper end 80 of the anvil member 78 so that on the second downward stroke of the reciprocating head 66 toward the end 58 of the punch 59, the lower end 81 of the anvil member 78 compacts against the top portion 82 of the part 23 of the member 24 to cause the parts 23 and 21 of the members 24 and 22 to elongate in the manner illustrated in FIG. 13 wherein the opposed pairs of flat sides 76 and 77 of the tubular portions 28 and 29 effectively are toggled over center so as to now define obtuse angles with the plane of the surface 27 of the member 24 so that the part 21 is staked in an interlocking manner in the tubular portion 29 of the member 27 at the short sides 77 thereof as it is believed that no toggling effect will take place on the long sides 74 and 75 of the tubular portions 28 and 29 thereof.

In this manner, the anvil member 78 comprises a second means of the head 66 that performs a staking step on a second stroke of the head 66.

The reciprocating head 66 and its female die member 70 and anvil member 78 perform the above forming and staking operation on the members 22 and 24 in the manner fully set forth in the aforementioned U.S. Pat. No. 4,035,901 which has been incorporated into this disclosure by the previous reference thereto so that the details of the structure and operation as to how the head 66 reciprocates so that on the first stroke thereof the same performs the forming operation previously described and on the second stroke thereof performs the staking operation previously described need not be further set forth as such details are fully set forth and claimed in the U.S. Pat. No. 4,035,901.

However, in the apparatus set forth in U.S. Pat. No. 4,035,901, the female die member 70 cooperates with the punch 59 in the manner illustrated in FIG. 11 to form the part 21 from the member 22 and lance through the member 24 whereas the female die member 70 of this invention is relatively wide relative to the punch 59 as illustrated in FIG. 10 so as to prevent such lancing of the part 23 from the member 24 so that the tubular portion 29 of the member 24 is formed without openings therein to provide a leakproof function along with the uninterrupted tubular portion 28 of the member 22.

After the members 22 and 24 have been joined together by the joint construction 20 of this invention by the unit 45 at the station 44 of the apparatus 40, the table or indexable carrier 42 indexes a new holding means 43 to the station 44 to have the unit 66 form and stake together the members 22 and 24 thereof in the manner previously set forth while the previously staked together members 22 and 24 are being indexed to the station 83 in the apparatus as illustrated in FIGS. 6 and 7 which comprises an ejecting station.

In particular, when that particular holding means 43 moves across a cam end 84 of the cam member 55 at the station 83 so as to have the lower free ends 56 of the posts 51 cam upwardly as illustrated in FIGS. 6 and 7, so as to move the upper surface 57 of the upper block 48 substantially coplanar with the top 58 of the punch 59 to fully strip the formed and staked together members 22 and 24 from the punch 59, suitable ejecting means (not shown) can remove the completed assembly of the members 22 and 24 from that particular holding means 43.

While the members 22 and 23 have been illustrated as being metal members that can be drawn and formed in the manner previously described, it is to be understood that the members could be formed of other types of suitable material, such as plastics and the like, if desired.

The operation of the apparatus 40 will now be described.

When a particular holding means 43 of the table 42 has been indexed to the station 44 with the members 22 and 24 having been previously assembled thereon in a manner previously described, the head 66 of the unit 45 is moved vertically downwardly to have the female die member 70 thereof force the members 24 and 22 downwardly over the end 58 of the punch 59, which extends above the top surface 57, 64 of the top plate 48, so that the punch 59 deforms the parts 21 and 23 outwardly beyond the plane of the surface 27 of the member 24 while forming the integral tubular portions 28 and 29 in the rectangular configurations as illustrated in FIGS. 11 and 12.

The head 66 is then raised and on the next downstroke thereof the anvil member 78 has been locked in place so that the same compresses against the top portion 82 of the part 23 of the member 24 to compress outwardly the parts 23 and 21 of the members 24 and 22 in the manner illustrated in FIG. 13 to toggle over the opposed pairs of flat sides 76 and 77 of the tubular portions 28 and 29 and thereby cause the part 21 of the member 22 to be staked to the tubular part 29 of the member 24 on the short sides 76 and 77 of the rectangular configuration thereof as illustrated in FIGS. 13 and 14.

The head 66 of the unit 45 is then raised from the holding means 43 and the table 42 is indexed to bring a new holding means 43 to the unit 45 while the table 42 indexes the particular holding means 43 from the station 44 to the eject station 83 so that as that particular holding means 43 moves across the cam surface 84 of the cam member 55, the posts 51 move the top plate 48 upwardly relative to the bottom plate 46 in a manner illustrated in FIGS. 6 and 7 to strip the completed assembly of the joined together members 22 and 24 from the top portion 71 of the punch 59 whereby suitable ejection apparatus, such as a jet of air or the like, removes the completed assembly from the holding means 43 at the station 83 whereby that particular holding means 43 can be subsequently indexed back to the station 44 to again repeat the process previously set forth.

Thus, it can be seen that this invention provides an improved joint construction 20 which is substantially leakproof and wherein the same has a polygonal configuration with at least one adjacent pair of flat sides of the tubular portions 28 and 29 having been toggled over center to define an obtuse angle with the plane of the surface 27 of the member 24 to cause the part 21 to interlock with the tubular portion 29 and when such joint construction is formed in a rectangular configuration, the opposed short sides of the rectangular configuration interlock in the manner illustrated in FIG. 13.

It is believed that such toggled tubular portions 28 and 29 of the interlocked members 22 and 24 add strength to the interlocking configuration thereof so as to prevent the tubular portion 28 from being pulled out of the tubular portion 29.

Accordingly, it can be seen that this invention not only provides an improved leakproof joint construction, but also this invention provides an improved method and apparatus for making such a leakproof joint construction or the like.

While the form and method of this invention now preferred have been illustrated and described as required by the Patent Statute, it is to be understood that other forms and method steps can be utilized and still fall within the scope of the appended claims.

What is claimed is:

1. In a leakproof joint construction for a pair of members disposed in abutting relation and having a substantially rectangular part of one of said members deformed into an adjacent substantially rectangular part of the other of said members so that said parts of said members are disposed completely beyond the plane of the outer surface of said other member while respectively being integrally interconnected to the remainder of said members by substantially straight sided tubular portions of said members, said parts being interlocked together by an outward staking of one pair of opposed sides of said tubular portion of said part of said one member into said tubular portion of said other member by a compaction of said parts, the improvement wherein said one pair of opposed sides of said one member and a corresponding one pair of opposed sides of said tubular portion of said other member each are initially deformed so as to be disposed at an acute angle relative to said plane of said other member and the other pair of opposed sides of said one member and the corresponding other pair of opposed sides of said tubular portion of said other member each are initially deformed so as to be substantially at a right angle relative to said plane of said other member, said one pair of opposed sides of said one member and said corresponding one pair of opposed sides of said other member each having been toggled over center when staked so as to be disposed at an obtuse angle relative to said plane of said other member while said other pair of opposed sides of said one member and said corresponding other pair of opposed sides of said other member each remain substantially at said right angle to said plane of said other member.

2. A leakproof joint construction as set forth in claim 1 wherein said rectangular configurations respectively have long and narrow sides, said one pair of opposed sides of each said member define said narrow sides of said rectangular configurations thereof.

* * * * *